US008590742B2

(12) United States Patent
Devos et al.

(10) Patent No.: US 8,590,742 B2
(45) Date of Patent: Nov. 26, 2013

(54) FLUID SUPPLY CONTACT

(75) Inventors: John A. Devos, Corvallis, OR (US); Michael M. Morrow, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 437 days.

(21) Appl. No.: 13/055,699

(22) PCT Filed: Jul. 1, 2009

(86) PCT No.: PCT/US2009/049414

§ 371 (c)(1), (2), (4) Date: Jan. 24, 2011

(87) PCT Pub. No.: WO2010/014340

PCT Pub. Date: Feb. 4, 2010

(65) Prior Publication Data

US 2011/0121024 A1 May 26, 2011

Related U.S. Application Data

(60) Provisional application No. 61/083,907, filed on Jul. 26, 2008.

(51) Int. Cl.
*B67D 7/22* (2010.01)

(52) U.S. Cl.
USPC ..... 222/41; 347/86

(58) Field of Classification Search
USPC ..... 222/325–327, 23–28, 41–47; 128/200.14–200.23; 347/6, 7, 85–87
See application file for complete search history.

(56) References Cited

U.S. PATENT DOCUMENTS

| | | | | |
|---|---|---|---|---|
| 5,520,166 | A * | 5/1996 | Ritson et al. | 128/200.14 |
| 5,769,073 | A * | 6/1998 | Eason et al. | 128/203.15 |
| 6,615,827 | B2 * | 9/2003 | Greenwood et al. | 128/200.23 |
| 7,191,777 | B2 * | 3/2007 | Brand et al. | 128/200.23 |
| 7,331,339 | B2 * | 2/2008 | Smith et al. | 128/200.14 |
| 7,665,461 | B2 * | 2/2010 | Zierenberg et al. | 128/200.21 |
| 8,141,550 | B2 * | 3/2012 | Lawrence et al. | 128/200.17 |

* cited by examiner

*Primary Examiner* — Lien Ngo

(57) ABSTRACT

An apparatus and method rotate a first contact (80, 180, 380) of a fluid supply body (70, 170) into contact with a second contact (40, 140, 340) of a fluid receiving device (22, 122, 322, 522).

15 Claims, 15 Drawing Sheets

FLUID SUPPLY CONTACT

RELATED APPLICATIONS

This application is the national phase of international application No. PCT/US2009/049414 filed Jul. 1, 2009, which in turn claims priority of U.S. provisional patent application Ser. No. 61/083,907 filed Jul. 26, 2008.

BACKGROUND

Some systems include a fluid supply container to supply fluid to a fluid receiving device. Securing the fluid supply container to the fluid receiving device, while facilitating communication between the fluid supply container and the fluid receiving device, may be difficult.

DETAILED DESCRIPTION OF THE EXAMPLE EMBODIMENTS

Figure 1:
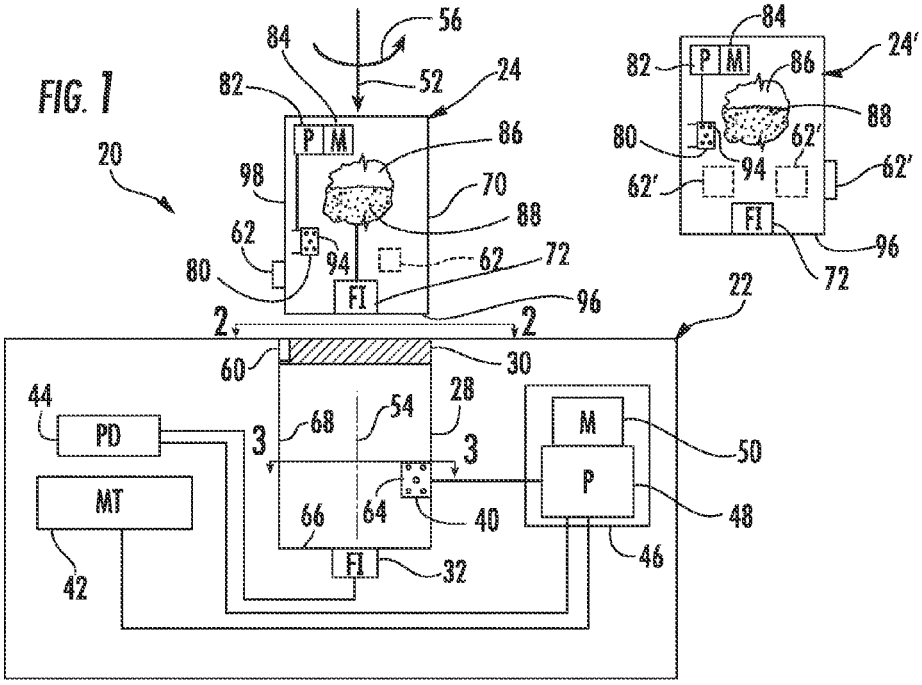
FIG. 1 is a schematic illustration of a fluid supply and receiving system according to an example embodiment.
Figure 2:
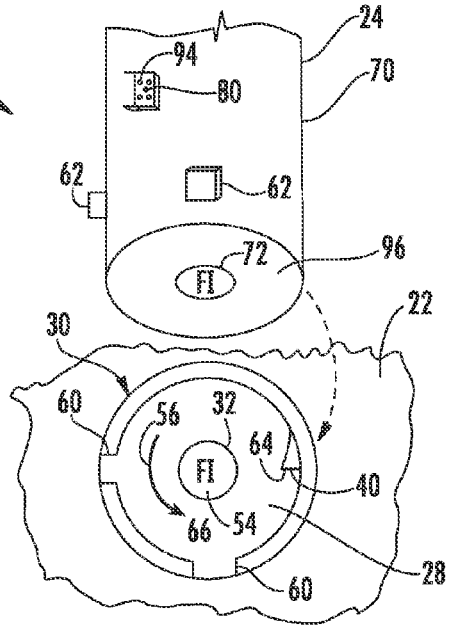
FIG. 2 is a fragmentary top plan view of a fluid receiver of the system of FIG. 1 and a perspective view of a fluid supply container of the system exploded away from the fluid receiver according to an example embodiment.
Figure 3:
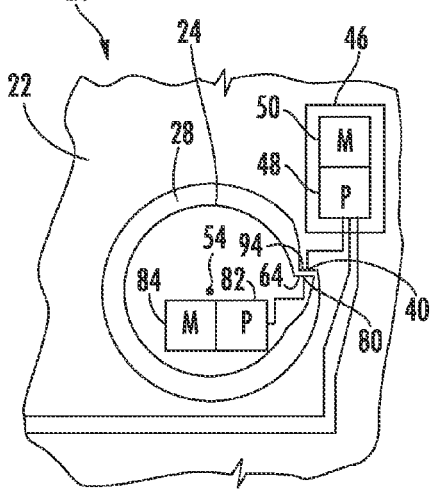
FIG. 3 is a fragmentary top plan view of the fluid supply container received within the fluid receiver according to an example embodiment.

FIGS. 1-3 schematically illustrate fluid supply and receiving system 20 according to an example embodiment. Fluid supply and receiving system 20 includes a fluid receiver 22 and a fluid supply container 24. As will be described hereafter, fluid receiver 22 and fluid supply container 24 are configured to facilitate a secure and reliable fluid connection between receiver 22 and container 24 while at the same time providing robust and reliable data, power, or signal communication between receiver 22 and container 24.

Fluid receiver 22 receives fluid from fluid supply container 24 and consumes the fluid supplied by container 24. In the particular example illustrated, fluid receiver 22 comprises a printing system configured to print one or more fluids, such as inks or other materials, onto a medium, wherein container 24 supplies the one or more fluids to the printing system. In other embodiments, fluid receiver 22 may comprise other devices which consume one or more fluids, wherein container 24 supplies the consumed fluids.

As shown by FIG. 1, fluid receiver 22 includes container receiving cavity 28, container entry 30, fluid interconnect 32, communication contact 40, media transport 42, print device 44 and controller 46 including processor 48 and memory 50. Container receiving cavity 28 comprises a depression, cavity or opening configured to at least partially receive fluid supply container 24. Cavity 28 serves as a dock or bay for receiving a fluid supply container. Cavity 28 is configured to allow insertion of container 24 into cavity 28 in the direction indicated by arrow 52 while container 24 is rotated within cavity 28 about axis 54 in the direction indicated by arrow 56. As will be described hereafter, such insertion results in container 24 being fluidly connected to receiver 22 and further results in data, power, or signal communication between container 24 and receiver 22. Although cavity 28 is illustrated as facing or opening in an upward direction, in another embodiment, cavity 28 may alternatively open or face in a sideways or horizontal direction.

Container entry 30 comprise the structure along an interior of cavity 28 configured to guide entry of container 24 into cavity 28. In the particular example illustrated, entry 30 is further configured to restrict or deny insertion of selected containers 24 into cavity 28. Entry 30 includes one or more key ways 60 located with respect to one another so as to match a corresponding set of matching key projections 62 of a particular container 24 which is to be received by cavity 28. Other containers 24, such as container 24', having key projections 62' which do not match key ways 60, in shape or in relative location or spacing, are denied full or complete entry or insertion into cavity 28. As a result, entry 30 prevents incorrect containers and incorrect fluid from being supplied via a particular cavity 28. In one embodiment, fluid receiver 22 may include a plurality of cavities 28 wherein each cavity 20 is substantially identical except that each cavity 28 has a unique entry 30 such that each cavity 28 is configured to specifically receive a corresponding assigned fluid supply container having a particular fluid.

In other embodiments, entry 30 may alternatively include key projections while containers 24 include key ways. In some embodiments, mixes of keys and keyways may be provided on both entry 30 and the container 24. Although entry 30 is illustrated as being at an end of cavity 28 near its mouth, in other embodiments, entry 30 may alternatively be inset into cavity 28. In still other embodiments, entry 30 may be omitted.

Fluid interconnect 32 comprises one or more structures configured to serve as a fluid interface with container 24. Fluid interconnect 32 enables fluid within an interior of container 24 to flow from container 24 to receiver 22. In one embodiment, fluid interconnect 32 comprises a needle configured to be inserted through a septum associated with container 24. In another embodiment, fluid interconnect 32 may comprise a septum configured to receive a needle associated with container 24. In yet other embodiments, fluid interconnect 32 may comprise other fluid interconnection or interfacing mechanisms.

In the particular example illustrated, fluid interconnect 32 extends along axis 54 within cavity 28. As a result, container 24 may be rotated about axis 54 without the fluid interconnect of container 24 being offset from fluid interconnect 32. Consequently, alignment of fluid interconnect 32 with a corresponding fluid interconnect of container 24 is less problematic. In other embodiments, fluid interconnect 32 may be provided at other locations within or along cavity 28. For example, in other embodiments, fluid interconnect 32 may alternatively be located along a surface extending away from axis 54 such as surface 64 or along a bottom or floor 66 of cavity 28.

Communication contacts 40 comprise one or more contacts configured to transmit data, power, or control signals between controller 46 of receiver 22 and an associated memory and/or processor carried by container 24. Communication contacts 40 are configured to make signal transmitting contact with one or more corresponding contacts of container 24. In one embodiment, communication contacts 40 comprise one or more electrical contact pads by which electrical signals representing data, power, or control signals may be transmitted. In another embodiment, communication contacts 40 may comprise one or more electrical pins configured to be received by one or more electrical sockets associated with container 24. In yet another embodiment, communication contacts 40 may comprise one or more electrical sockets configured to receive corresponding electrical pins associated with container 24. As shown by FIG. 1, communication contacts 40 are each connected to processor 48 of controller 46 to transmit data, power, and/or control signals to processor 48.

As shown by FIG. 2, communication contacts 40 are located along surface 64. Surface 64 extends away from axis 54 of cavity 28. In one embodiment, surface 64 comprises a radial surface with respect to axis 54. Surface 64 is eccentric with respect to axis 54. Surface 64 is configured such that corresponding communication contacts of container 24 may be rotated into contact with contacts 40 to a rotation a container 24 about axis 54. During such rotation, communication contacts 40 are substantially opposite to and face the corresponding contacts of container 24 just prior to connection. In other words, just prior to connection of communication contacts 40 and corresponding contacts of container 24, surface 64 is substantially parallel to and faces the opposing surface along which the communication contacts of container 24 extend. As a result, transverse movement, rubbing or frictional sliding of such surfaces of communication contacts of receiver 22 and container 24 is minimized or eliminated, reducing deformation and frictional wear to increase the reliability and robustness of system 20.

In other embodiments, communication contacts 40 may alternatively be located along floor 66 or along circumferential sides 68 of cavity 28. For example, in one embodiment, contacts 40 may be formed along a ring extending about axis 54 along floor 66. In another embodiment, contacts 40 may be formed in a ring about axis 54 along side 68. In still another embodiment, contacts 40 may be provided at floor 66 or side 68, wherein the corresponding communication contacts of container 24 are rotated into close proximity or contact with contacts 40 to facilitate communication between container 24 and receiver 22.

Media transport 42 comprises a device or mechanism configured to transport or move media relative to input device 44. In one embodiment, media transport 42 is configured to supply a web of material. In another embodiment, media transport 42 may be configured to supply individual sheets of media to print device 44. In one embodiment, media transport 42 may include a drum. In another embodiment, media transport 42 may include one or more rollers, belts, conveyors or other devices. In embodiments where fluid receiver 22 is not a printing system, media transport 42 may have other configurations or may be omitted.

Printing device 44 comprises device configured to deposit, pattern or apply printing material upon media supplied by media transport 42. Printing device 44 receives printing material, in fluid form, from fluid interface 32. In one embodiment printing device 44 comprises a drop-on-demand inkjet printer. In one embodiment, printing device 44 comprises a thermoresistive inkjet printer. In another embodiment, printing device 44 comprises a piezo resistive inkjet printer. In one embodiment, print device 44 is scanned or moved across the media being printed upon during printing. In one embodiment, print device 44 receives fluid, such as ink, from fluid interconnect 32 as part of an off-axis fluid supply system. In yet another embodiment, cavity 28 may be provided as part of the carriage which also carries print device 44, wherein cavity 28 and container 24 as well as print device 44 are scanned or moved across the media being printed upon. In another embodiment, printing device 44 spans the media being printed upon such as with a page-wide-array printer.

Controller 46 communicates with container 24 using communication contacts 40. Controller 46 further generates control signals directing the operation of media transport 42 and print device 44 to print or pattern text or images upon the media. In one embodiment, controller 46 may also generate control signals directing supply of fluid by container 24. As shown by FIG. 1, controller 46 includes processor 48 and memory 50.

Processor 48 comprises one or more processing units. For purposes of this application, the term "processing unit" shall mean a presently developed or future developed processing unit that executes sequences of instructions contained in a memory, such as memory 50. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 46 may be embodied as part of one or more application-specific integrated circuits (ASICs). Unless otherwise specifically noted, the controller is not limited to any specific combination of hardware circuitry and software, nor to any particular source for the instructions executed by the processing unit.

Container 24 supplies fluid to fluid receiver 22. Container 24 includes body 70, keys 62, fluid interconnect 72, communication contacts 80, processor 82 and memory 84. Body 70 comprises one or more structures forming an interior 86 containing fluid 88 to be supplied to fluid receiver 22. Body 70 further supports the remaining elements are components of container 24 to fluid interconnect 72, communication contacts 80, processor 82 and memory 84. Body 70 is configured to be rotated upon insertion into cavity 28. As shown by FIGS. 2 and 3, body 70 is substantially cylindrical, facilitating insertion and rotation of body 70. In other embodiments, body 70 may have other shapes which also facilitate rotation of body 70 within cavity 28 of receiver 22.

Keys 62 cooperate with keyways 60 of entry 30 of receiver 22 to guide or align container 24 with cavity 28 during insertion of container 24 into cavity 28. As noted above, in the particular embodiment illustrated, keys 62 further cooperate with entry 30 to restrict particular containers 24 the may be inserted into cavity 28. For example, as noted above, keys 62' of container 24' prevent container 24' from being inserted into cavity 28. Likewise, another cavity 28 associated with receiver 22 or another distinct system 20 may include an entry 30 having keyways specifically configured to permit insertion of container 24' into its cavity 28 while preventing insertion of container 24 into its cavity 28. In yet other embodiments, keys 62 may be omitted.

Fluid interconnect 72 comprises one or more structures configured to serve as a fluid interface with container 24. Fluid interconnect 72 enables fluid within an interior of container 24 to flow from container 24 to receiver 22. In one embodiment, fluid interconnect 72 comprises a needle configured to be inserted through a septum associated with receiver 22. In another embodiment, fluid interconnect 72 may comprise a septum configured to receive a needle associated with receiver 22. In yet other embodiments, fluid interconnect 72 may comprise other fluid interconnection or interfacing mechanisms.

In the particular example illustrated, fluid interconnect 72 extends along axis 54 when container 24 is within cavity 28. As a result, container 24 may be rotated about axis 54 without the fluid interconnect 72 of container 24 being offset from fluid interconnect 32. Consequently, alignment of fluid interconnect 32 with the corresponding fluid interconnect 72 of container 24 is less problematic. In other embodiments, fluid interconnect 72 may be provided in other locations on body 70. For example, in other embodiments, fluid interconnect 72 may alternatively be located along a surface extending away from axis 54 such as surface 94 or along a bottom 96 of body 70.

Communication contacts 80 comprise one or more contacts configured to transmit data, power, or control signals between processor 82 and/or memory 84 carried by container 24 and communication contacts 40 of receiver 22. Communication contacts 80 are configured to make signal transmitting contact with one or more corresponding contacts 40 of container 24. In one embodiment, communication contacts 80 comprise one or more electrical contact pads by which electrical signals representing data, power, or control signals may be transmitted. In another embodiment, communication contacts 80 may comprise one or more electrical pins configured to be received by one or more electrical sockets serving as contacts 40. In yet another embodiment, communication contacts 80 may comprise one or more electrical sockets configured to receive corresponding electrical pins serving as contacts 40. As shown by FIG. 1, communication contacts 80 are each connected to processor 82 to transmit data, power, and/or control signals to processor 82. In another embodiment image processor 82 is omitted, contacts 80 may be directly connected to memory 84, wherein data is read from memory 84 by receiver 22.

As shown by FIG. 2, communication contacts 80 are located along surface 94. Surface 94 extends away from axis 54 of cavity 28. In one embodiment, surface 64 comprises a radial surface with respect to a centerline of container 24 and with respect to axis 54 when container 54 is received within cavity 28. Surface 94 is eccentric with respect to axis 54. Surface 94 is configured such that communication contacts 80 of container 24 may be rotated into contact with contacts 40 upon rotation of container 24 within cavity 28 and about axis 54. During such rotation, communication contacts 80 are substantially opposite to and face the corresponding contacts 40 just prior to connection. In other words, just prior to connection of communication contacts 80 and corresponding contacts 40, surface 94 is substantially parallel to and faces the opposing surface 64. As a result, transverse movement, rubbing or frictional sliding of such surfaces and the communication contacts 80 and 40 is minimized or eliminated, reducing deformation and frictional wear to increase the reliability and robustness of system 20.

In other embodiments, communication contacts 80 may alternatively be located along floor 96 or along circumferential sides 98 of body 70. For example, in one embodiment, contacts 80 may be formed along a ring extending about axis 54 along floor 96. In another embodiment, contacts 90 may be formed in a ring about axis 54 along side 98. In such embodiments with rings of one or more contacts 80, communication is facilitated without precise rotational alignment or positioning of container 24 with respect to cavity 28. In still another embodiment, contacts 80 may be provided at a discrete location (not a continuous ring) at bottom 96 or side 98, wherein contacts 80 are rotated into close proximity or contact with contacts 40 to facilitate communication between container 24 and receiver 22.

Processor 82 comprises a processing unit configured to receive and potentially analyze signals from various sensors associated with container that sense various characteristics of the fluid within container 24 and properties of container 24. Processor 82, following instructions contained in memory 84, may generate control signals storing additional information regarding sensed attributes in memory 84 or transmitting control signals to controller 46 or components of fluid receiver 22. For example, in one embodiment, memory 84 may store additional options, upgrades, feature unlocking codes or other software programming for fluid receiver 22, wherein upon connection of container 24 to fluid receiver 22, processor 82 transmits such additional software patches, upgrades or authorization codes to fluid receiver 22 such that fluid receiver 22 is provided with additional features, functions or enhanced performance. In yet other embodiments, processor 82 may store attributes of fluid 88 and may transmit such stored attributes to fluid receiver 22 upon connection of container 24 to fluid receiver 22. Examples of such attributes include fluid type, fluid age, fluid volume, the number of sheets or amount of media printed upon using fluid from container 24 and the like.

In still other embodiments, processor 82 may be omitted. In such embodiments, memory 84 may store attributes of fluid 88 or of container 24 for being read or retrieved by processor 48 of fluid receiver 22. In some embodiments, processor 48 may be configured to additionally write data to memory 84 of container 24 for later retrieval or access. Overall, such communication between container 24 and fluid receiver 22 provides system 20 with enhanced performance, enhanced versatility and feature upgrades or additions.

As shown in FIG. 2, container 20 is first aligned with entry 30 of cavity 28 such that keys 62 are appropriately aligned with key ways 60. Upon such alignment, container 24 is inserted through entry 30 into cavity 28 by being translated along axis 54. During such insertion or after such an insertion, fluid interconnect 72 is brought into engagement with fluid interconnect 32 providing fluid communication between container 24 and receiver 22.

Once sufficiently inserted into cavity 28, container 24 is rotated in the direction indicated by arrow 56 in FIG. 2. As shown by FIG. 3, such rotation rotates contacts 80 along surface 94 into face-to-face abutment with contacts 40 surface 64. Consequently, a data, power, or signal transmitting connection is achieved between container 24 and receiver 22. Data, power, and/or communication signals may be transmitted across contacts 80 and 40 between controller 46 and one or both of processor 82 or memory 84 of container 24. Withdrawal of container 24 for repair or replacement is achieved by repeating the above steps in reverse. In particular, container 24 is rotated in a reverse direction as that of arrow 56 and is then translated in a direction opposite to arrow 52 to withdraw container 24 from cavity 28.

Figure 4:
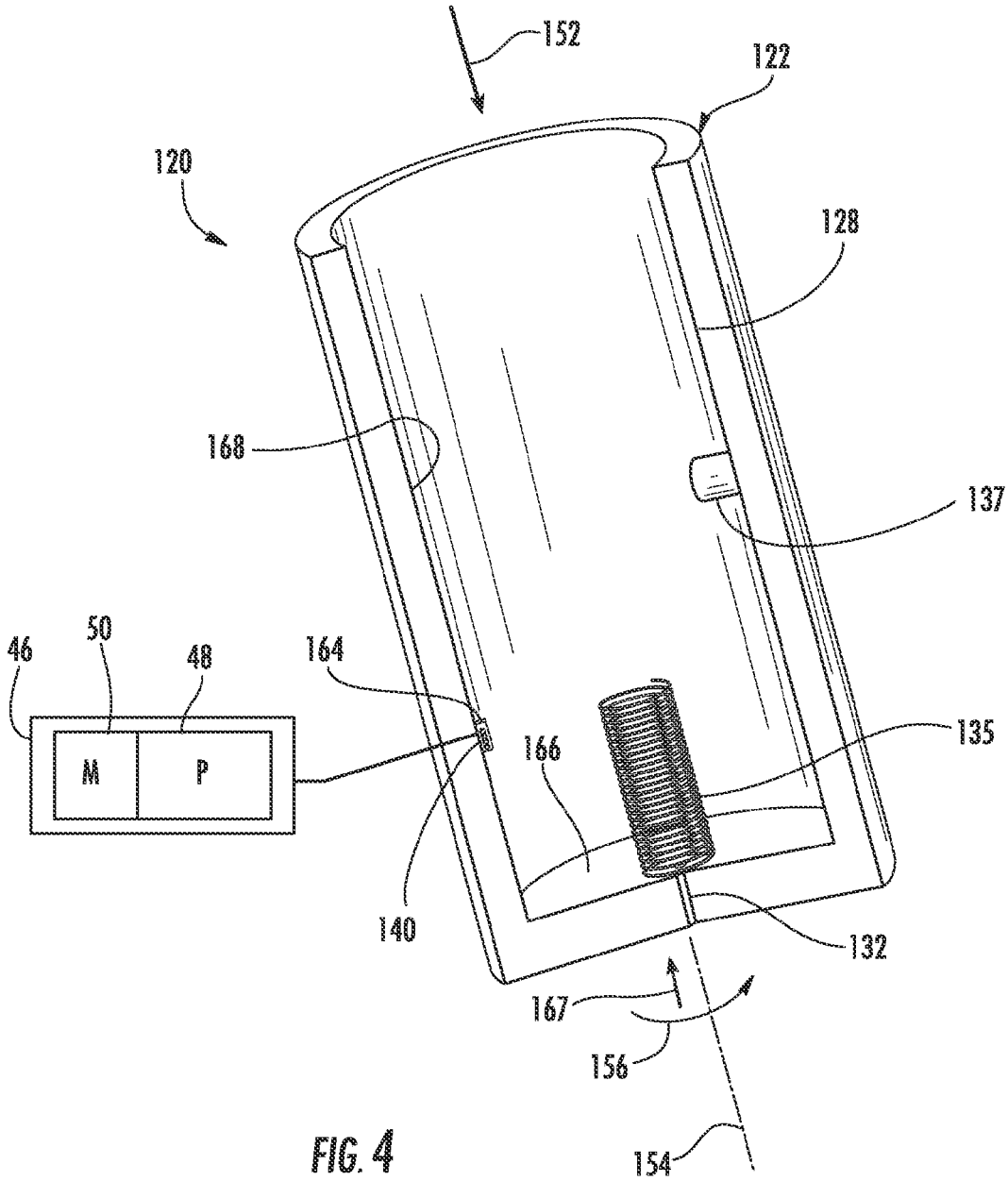
FIG. 4 is a sectional view of a fluid receiver of another embodiment of the fluid supply and receiving system of FIG. 1 according to an example embodiment.

FIGS. 4-9 illustrate fluid supply and receiving system 120, another embodiment of system 20 shown in FIG. 1. System 120 includes fluid receiver 122 (a portion of which is shown in FIG. 4) and fluid container 124 (shown in FIG. 5). As with fluid receiver 22 and container 24 of system 20, fluid receiver 122 and fluid supply container 124 are configured to facilitate a secure and reliable fluid connection between receiver 122 and container 124 while the same time providing robust and reliable data, power, or signal communication between receiver 122 and container 124.

Like fluid receiver 22, fluid receiver 122 receives fluid from fluid supply container 124 and consumes the fluid supplied by container 124. In the particular example illustrated, fluid receiver 122 comprises a printing system configured to print one or more fluids, such as inks or other materials, onto a medium, wherein container 124 supplies the one or more fluids to the printing system. In other embodiments, fluid receiver 122 may comprise other devices which consume one or more fluids, wherein container 124 supplies the consumed fluids.

Fluid receiver 122 includes container receiving cavity 128 (shown in FIG. 4), fluid interconnect 132, bias 135, cam follower 137, communication contacts 140, media transport 42 (shown in FIG. 1), print device 44 (shown in FIG. 1) and controller 46 including processor 48 and memory 50. Container receiving cavity 128 comprises a depression, cavity or opening configured to at least partially receive fluid supply container 124. Cavity 128 serves as a dock or bay for receiving a fluid supply container. Cavity 128 is configured to allow insertion of container 124 into cavity 128 in the direction indicated by arrow 152 while container 124 is rotated within cavity 128 about axis 154 in the direction indicated by arrow 156. As will be described hereafter, such insertion results in container 124 being fluidly connected to receiver 122 and further results in data, power, or signal communication between container 124 and receiver 122. Although cavity 128 is illustrated as facing or opening in an upward direction, in another embodiment, cavity 128 may alternatively open or face in a sideways or horizontal direction.

Fluid interconnect 132 comprises one or more structures configured to serve as a fluid interface with container 124. Fluid interconnect 132 enables fluid within an interior of container 124 to flow from container 124 to receiver 122. In the particular embodiment illustrated, fluid interconnect 132 comprises a passage through it a needle may be inserted. In another embodiment, fluid interconnect 132 may alternatively comprise a septum. In another embodiment, fluid interconnect 132 may comprise a needle configured to be inserted through a septum associated with container 124. In yet other embodiments, fluid interconnect 132 may comprise other fluid interconnection or interfacing mechanisms.

In a particular example illustrated, fluid interconnect 132 extends along axis 154 within cavity 128. As a result, container 124 may be rotated about axis 154 without the fluid interconnect of container 124 being offset from fluid interconnect 132. Consequently, alignment of fluid interconnect 132 with a corresponding fluid interconnect of container 124 is less problematic. In other embodiments, fluid interconnect 132 may be provided in other locations within or along cavity 128. For example, in other embodiments, fluid interconnect 132 may alternatively be located along a surface extending away from axis 154 such as surface 164 or along a bottom or floor 166 of cavity 128.

Bias 135 comprises one or more mechanisms configured to resiliently urge or force a container received within cavity 128 along axis 154 in the direction indicated by arrow 167. As will be described hereafter, bias 135 urges container and its associated cam against cam follower 137 which is captured between bias 135 and cam follower 137. Bias 135 cooperates with cam follower 137 and the cam of container 124 to precisely control or regulate the axial positioning of the container 124 while within cavity 128. In the particular example illustrated, bias 135 is illustrated as a compression spring centrally located about fluid interconnect 132. Because bias 132 is concentrically located, bias 135 applies a uniform force about and along axis 154. In other embodiments, bias 135 may alternatively comprise one or more other springs, resilient foams and the like which may or may not be concentrically located with respect to axis 154.

Cam follower 137 comprises a projection extending from side 168 of cavity 128. Cam follower 137 is configured to engage and ride or slide upon a corresponding cam associated with container 124 (shown in FIG. 5). Cam follower 137 cooperates with the associated cam to datum or precisely locate container 124 within cavity 128 and with respect to fluid interconnect 132 and communication contacts 140.

Communication contacts 140 comprise one or more contacts configured to transmit data, power, or control signals between controller 46 (shown to FIG. 1) of receiver 22 and an associated memory and/or processor carried by container 124. Communication contacts 140 are configured to make signal transmitting contact with one or more corresponding contacts of container 124. In one embodiment, communication contacts 140 comprise one or more electrical contact pads by which electrical signals representing data, power, or control signals may be transmitted. In another embodiment, communication contacts 140 may comprise one or more electrical pins configured to be received by one or more electrical sockets associated with container 124. In yet another embodiment, communication contacts 40 may comprise one or more electrical sockets configured to receive corresponding electrical pins associated with container 124. As shown by FIG. 4, communication contacts 140 are each connected to processor 48 of controller 46 to transmit data, power, and/or control signals to processor 48.

As shown by FIG. 4, communication contacts 140 are located along surface 164. Surface 164 extends away from axis 154 of cavity 128. In one embodiment, surface 164 comprises a radial surface with respect to axis 154. Surface 164 is eccentric with respect to axis 154. Surface 164 is configured such that corresponding communication contacts of container 124 may be rotated into contact with contacts 140 upon rotation of container 124 about axis 154. During such rotation, communication contacts 140 are substantially opposite to and face the corresponding contacts of container 124 just prior to connection. In other words, just prior to connection of communication contacts 140 and corresponding contacts of container 124, surface 164 is substantially parallel to and faces the opposing surface along which the communication contacts of container 124 extend. As a result, transverse movement, rubbing or frictional sliding of such surfaces of communication contacts of receiver 122 and container 124 is minimized or eliminated, reducing defamation and frictional wear to increase the reliability and robustness of system 120.

Controller 46 and its processor 48 and memory 50 are described above with respect to FIG. 1 and are schematically shown in FIG. 4. Controller 46 is configured to read data from a memory associate with container 124 or to receive data, power, signal or control signals from a processor associated with container 124. Controller 46 is further configured to control functions of fluid receiver 122. Control of such functions or devices of fluid receiver 122 are least partially based upon signals or data received from container 124.

Figure 5:
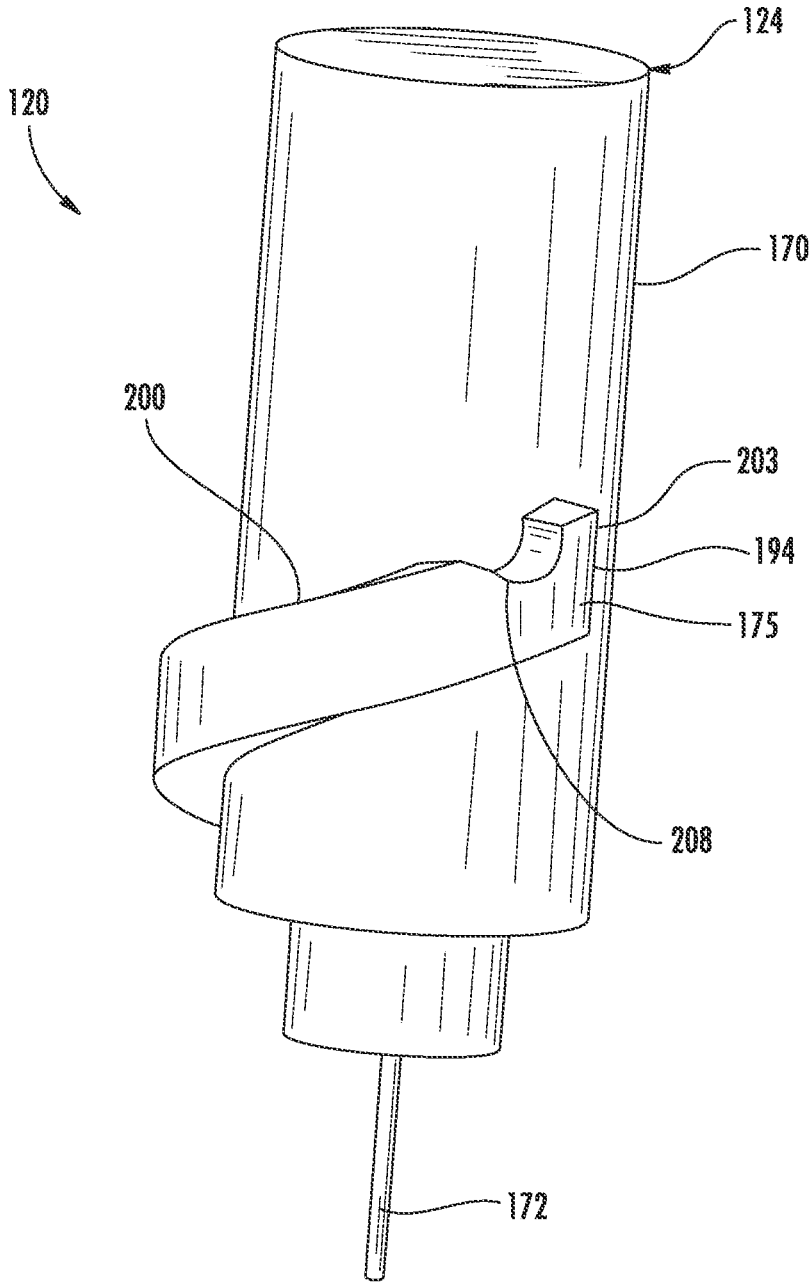
FIG. 5 is a perspective view of the fluid supply container of the system of FIG. 4 according to an example embodiment.

As shown by FIG. 5, fluid container 124 includes body 170, fluid interconnect 172, cam 175, communication contacts 180 (shown in FIG. 6), processor 182 and memory 184. Body 170 comprises one or more structures forming an interior 186 containing fluid 188 to be supplied to fluid receiver 122. Body 170 further supports the remaining elements or components of container 124 including fluid interconnect 172, communication contacts 180, processor 182 and memory 184. Body 70 is configured to be rotated upon insertion into cavity 128. Body 170 is substantially cylindrical, facilitating insertion and rotation of body 170. In other embodiments, body 170 may have other shapes which also facilitate rotation of body 170 within cavity 128 of receiver 122.

Fluid interconnect 172 comprises one or more structures configured to serve as a fluid interface with container 124. Fluid interconnect 172 enables fluid within an interior of container 124 to flow from container 124 to receiver 122. In the embodiment illustrated, fluid interconnect 172 comprises a needle configured to be inserted through the passage serving as fluid interconnect 132 of receiver 122. In another embodiment, fluid interconnect 172 may comprise a septum configured to receive a needle associated with receiver 122. In yet other embodiments, fluid interconnect 172 may comprise other fluid interconnection or interfacing mechanisms.

In the particular example illustrated, fluid interconnect 172 extends along axis 154 when container 124 is within cavity 128. As a result, container 124 may be rotated about axis 154 without the fluid interconnect 172 of container 124 being offset from fluid interconnect 132. Consequently, alignment of fluid interconnect 132 with the corresponding fluid interconnect 172 of container 124 is less problematic. In other embodiments, fluid interconnect 172 may be provided in other locations on body 170. For example, in other embodiments, fluid interconnect 172 may alternatively be located along a surface extending away from axis 154 such as surface 194 (shown in FIG. 6).

Cam 175 comprises one or more structures configured to provide a surface that engages cam follower 137 during insertion of container 124 into cavity 128 to guide or direct insertion of container 124 into cavity 128. In the particular example illustrated, cam 175 comprises a ledge or track 200 helically extending about a centerline of body 170 and container 124. Track does not extend completely about container 124 and terminates at surface 194. Surface 194 borders a passage 203 axially extending across track 200.

Passage 203 is configured to permit insertion of container 124 into cavity 128 such that cam follower 137 (shown in FIG. 4) passes through passage 203 so as to be positioned along and in contact with track 200. In one embodiment, passage 203 has a shape specifically chosen to match a particular shape of cam follower 137 so as to serve as a key way, wherein cam follower 137 serves as a key. As a result, passage 203 restricts what particular containers 124 may be inserted into cavity 128. In other embodiments, container 124 may include multiple passages 203 extending through track 200 and receiver 122 may include multiple cam followers 137 spaced about axis 154, wherein the shape and/or location of the multiple passages form key ways and the shape or location of the multiple cam followers 137 form keys for allowing selected containers or more 124 to be fully inserted into cavity 128 while denying complete insertion of other containers 124. In some embodiments, the one or more cam followers or 137 and the one or more tracks 200 may additionally or alternatively be color-coordinated or color-coded to indicate which of the plurality of containers containing different fluids are to be inserted into cavity 128. For example, in one embodiment, cam follower 137 maybe colored yellow, indicating that only those containers having yellow cam followers 137 are to be inserted into cavity 128.

As further shown by FIG. 5, track 200 includes a detent 208 configured to at least partially receive cam follower 137 (shown in FIG. 4) at a selected location along track 200. Detent 208 is located so as to indicate to a person inserting container 124 when container 124 has been sufficiently rotated and lowered into cavity 128 such that communication contacts 180 of container 124 are in sufficient proximity or are in contact with communication contacts 140 of receiver 122 such that communication may be achieved. Detent 208 may further serve to retain container 124 in place within cavity 128.

In the particular example illustrated in which communication contacts 180 are provided along surface 194, detent 208 is located along track 200 in close proximity to surface 194. In other embodiments, detent 208 may be provided in other locations. In still other embodiment, track 200 may alternatively include a protuberance instead of detent 208, wherein cam caller 137 includes a corresponding detent that receives a protuberance when communication contacts 180 of container 124 are in sufficient proximity or are in contact with communication contacts 140 of receiver 122 such that communication may be achieved.

Figure 6:
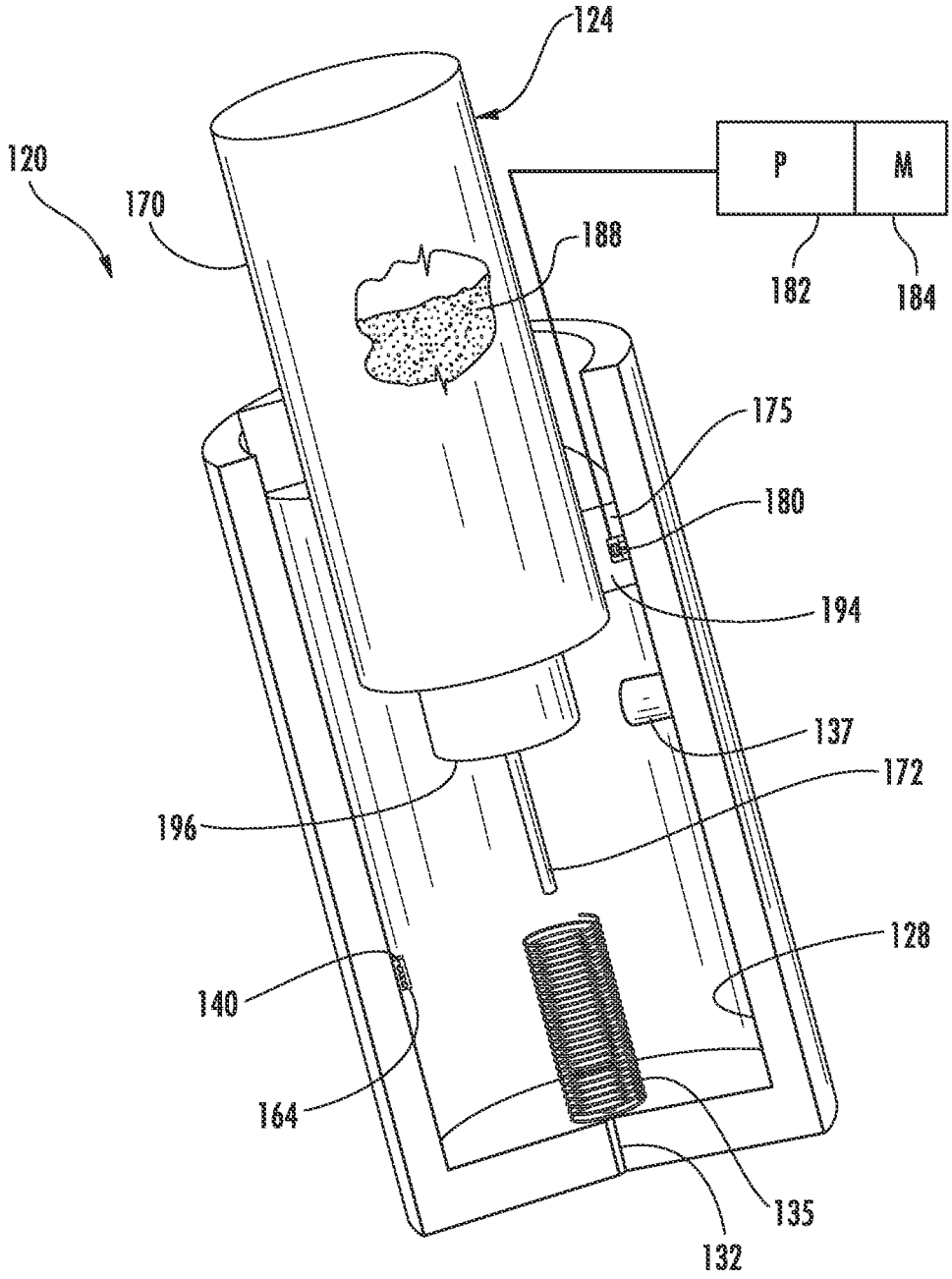
FIGS. 6-9 are perspective views of the system of FIGS. 4 and 5 illustrating the fluid receiver in section and illustrating insertion of the container into the receiver according to an example embodiment.

Communication contacts 180 (shown in FIG. 6) comprise one or more contacts configured to transmit data, power, or control signals between processor 182 and/or memory 184 carried by container 124 and communication contacts 140 of receiver 122. Communication contacts 180 are configured to make signal transmitting contact with one or more corresponding contacts 140 of container 124. In one embodiment, communication contacts 180 serve as electrical interconnects and comprise one or more electrical contact pads by which electrical signals representing data, power, or control signals may be transmitted. In another embodiment, communication contacts 180 may comprise one or more electrical pins configured to be received by one or more electrical sockets serving as contacts 140. In yet another embodiment, communication contacts 180 may comprise one or more electrical sockets configured to receive corresponding electrical pins serving as contacts 140. As shown by FIG. 6, communication contacts 180 are each connected to processor 182 to transmit data, power, and/or control signals to processor 182. In another embodiment, in which processor 182 is omitted, contacts 180 may be directly connected to memory 184, wherein data is read from memory 184 by receiver 122.

As shown by FIG. 6, communication contacts 180 are located along surface 194. Surface 194 extends away from axis 154 of cavity 128. In one embodiment, surface 194 comprises a radial surface with respect to a centerline of container 124 and with respect to axis 154 when container 154 is received within cavity 128. Surface 194 is eccentric with respect to axis 154. Surface 194 is configured such that communication contacts 180 of container 124 may be rotated into contact with contacts 140 upon rotation a container 124 within cavity 128 and about axis 154. During such rotation, communication contacts 180 are substantially opposite to and face the corresponding contacts 140 just prior to connection. In other words, just prior to connection of communication contacts 180 and corresponding contacts 140, surface 194 is substantially parallel to and faces the opposing surface 164. As a result, transverse movement, rubbing or frictional sliding of such surfaces and the communication contacts 180 and 140 is minimized or eliminated, reducing deformation and frictional wear to increase the reliability and robustness of system 120.

In other embodiments, communication contacts 180 may alternatively be located along bottom 196 or along circumferential sides 198 of body 170. For example, in one embodiment, contacts 180 may be formed along a ring extending about axis 154 along bottom 196. In another embodiment, contacts 180 may be formed in a ring about axis 154 along side 198. In such embodiments with rings of one or more contacts 180, communication is facilitated without precise rotational alignment or positioning of container 124 with respect to cavity 128. In still another embodiment, contacts 180 may be provided at a discrete location (not a continuous ring) at bottom 196 or side 198, wherein contacts 180 are rotated into close proximity or contact with contacts 140 to facilitate communication between container 124 and receiver 122.

Processor 182 comprises a processing unit configured to receive and potentially analyze signals from various sensors associated with container 124 to sense various characteristics of the fluid within container 124 and properties of container 124. Processor 182, following instructions contained in memory 184, May generate control signals storing additional information regarding sensed attributes in memory 184 or transmitting control signals to controller 46 or components of fluid receiver 122. For example, in one embodiment, memory 184 may store additional options, upgrades, feature unlocking codes or other software programming for fluid receiver 122, wherein upon connection of container 124 to fluid receiver 122, processor 82 transmits such additional software patches, upgrades or authorization codes to fluid receiver 122 such that fluid receiver 122 is provided with additional features, functions or enhanced performance. In yet other embodiments, processor 82 may store attributes of fluid 88 and may transmit such stored attributes to fluid receiver 122 upon connection of container 124 to fluid receiver 122. Examples of such attributes include fluid type, fluid age, fluid volume, the number of sheets of media printed upon using fluid from container 124, authorization for use of container 124 and the like.

In still other embodiments, processor 182 may be omitted. In such embodiments, memory 184 may store attributes of fluid 188 or of container 124 for being read or retrieved by processor 148 of fluid receiver 122. In some embodiments, processor 148 may be configured to additionally write data to memory 184 of container 124 for later retrieval or access. Overall, such communication between container 124 and fluid receiver 122 provides system 120 with enhanced performance, enhanced versatility and feature upgrades or additions.

Figure 7:
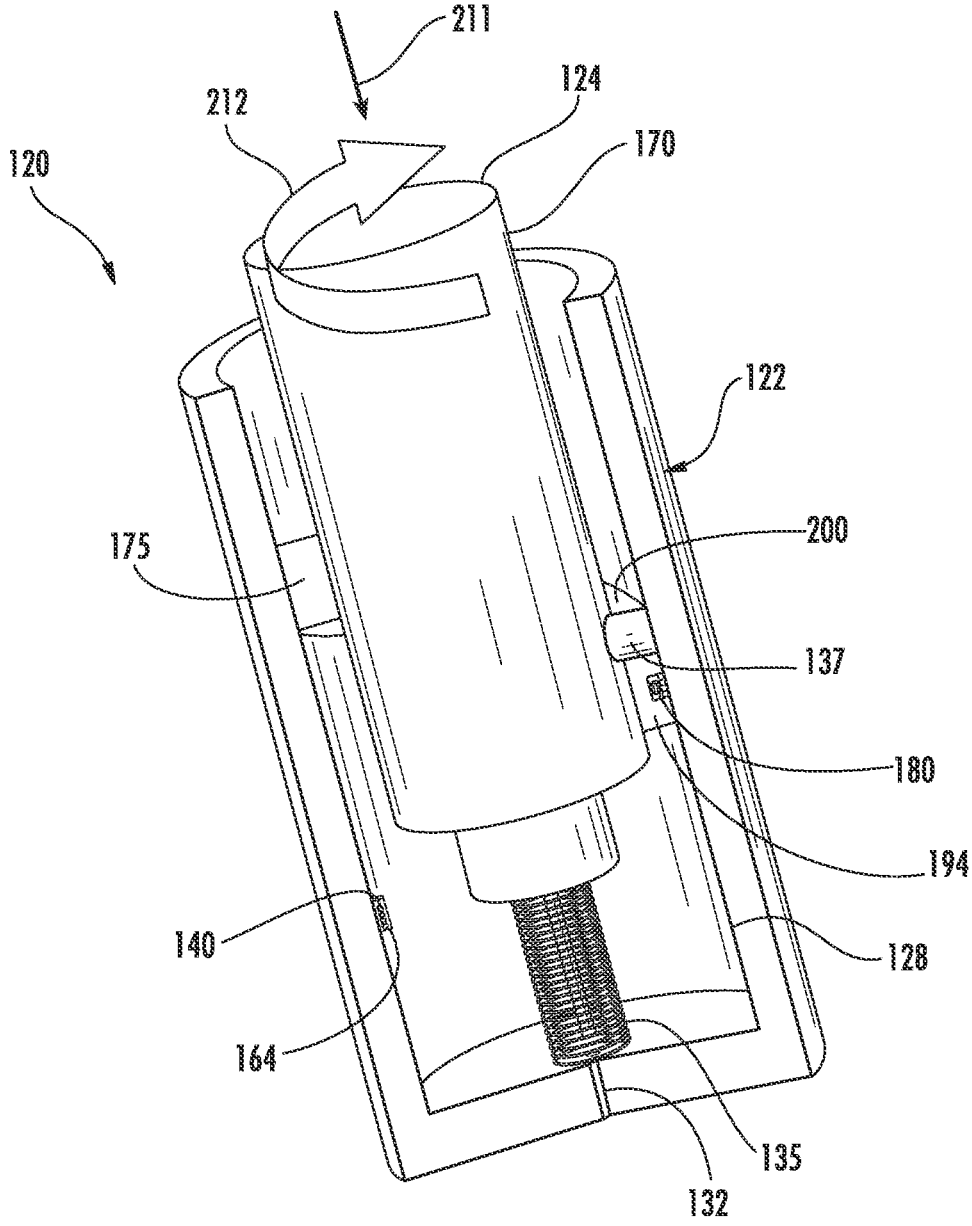
Figure 8:
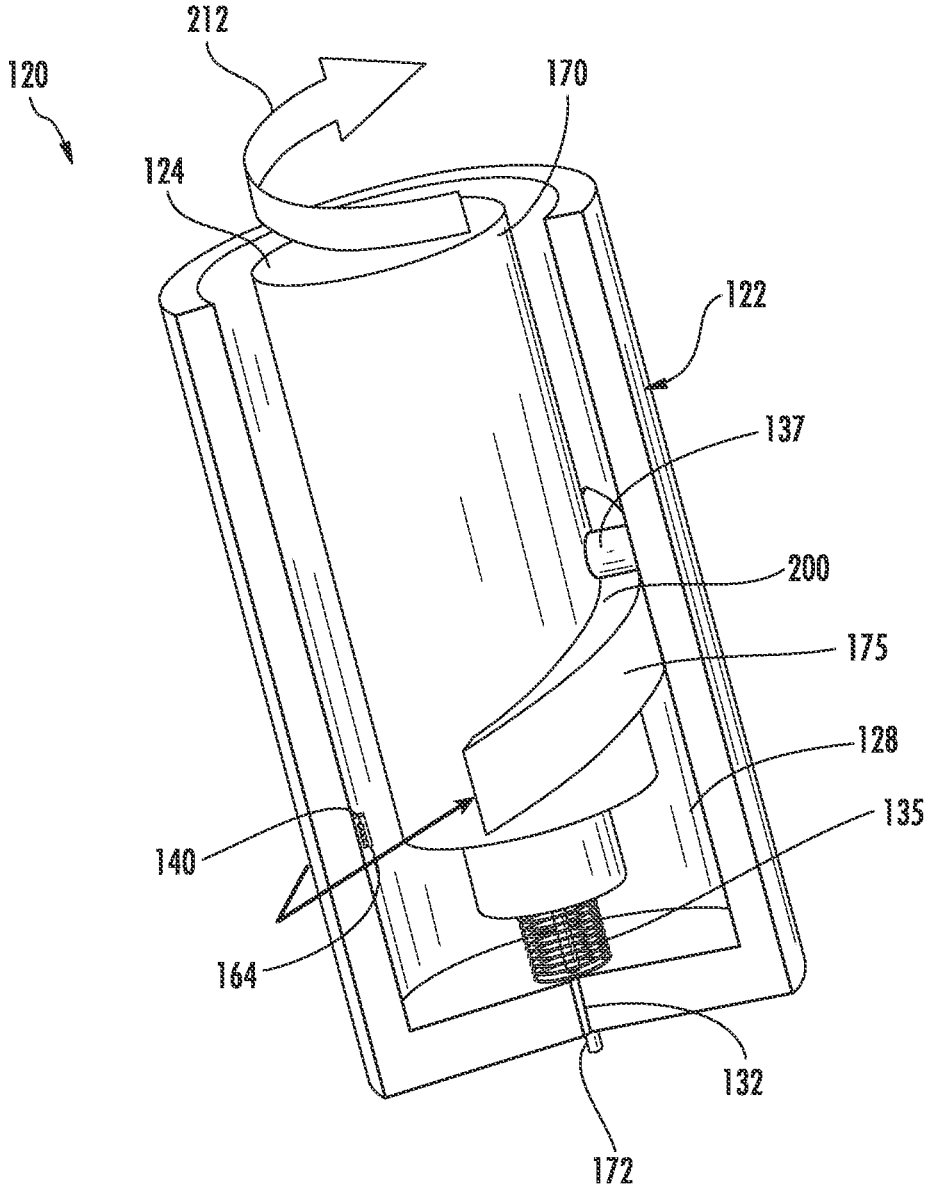
Figure 9:
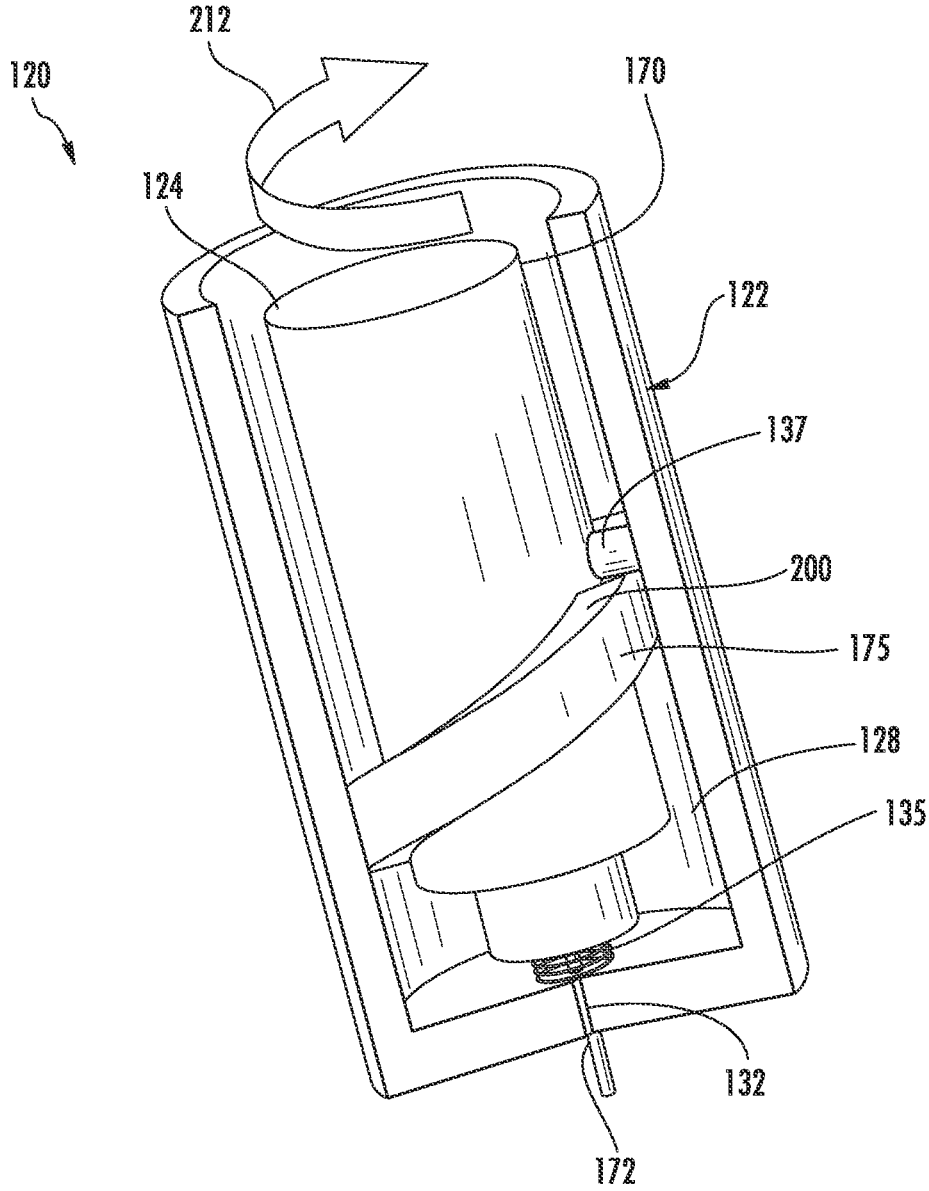

FIGS. 7-9 illustrate insertion of container 124 into cavity 128 of receiver 122. As shown by FIG. 7, passage 203 of container 124 is initially aligned with cam follower 137 within cavity 128. Once aligned, container 124 is lowered into cavity 128 in the direction indicated by arrow 211 such that cam follower 137 passes through or across passage 203. During such insertion, container 124 may compress bias 135. After being sufficiently lowered into cavity 128 such that cam follower 137 has completely passed through passage 203, container 124 is rotated in the direction indicated by arrow 212 to position track 200 and cam follower 137 opposite or axially across from one another. As a result, bias 135 resiliently urges track 200 against a lower surface (as seen in FIG. 7) of cam follower 137.

As shown by FIG. 8, container 124 is configured to be rotated in the direction indicated by arrow 212. Because track 200 is helical, such rotation further results in container 124 being translated against bias 135 further into cavity 128. As shown by FIG. 9, container 124 continues to be rotated in the direction indicated by arrow 212 until detent 208 receives cam follower 137. When detent 208 of track 200 receives cam follower 137, communication contacts 180 along surface or 194 (shown in FIG. 6) are in contact with or in sufficient proximity to communication contacts 140 of receiver 122 such that data, power, or control signals may be transmitted across contacts 140 and contacts 180. Due to the reception of cam follower 137 by detent 208, the person inserting container 124 is provided with a tactile indication and an audible indication that container 124 has been sufficiently inserted and rotated. At the same time, 208 also serves as a retainer by retaining container 124 in place against bias 135 with contacts 180 in contact or in sufficient proximity to contacts 140 for communication.

FIGS. 10-14 illustrate fluid supply and receiving system 320, another embodiment of system 20. System 320 is similar to system 120 except the system 320 includes fluid receiver 322 and fluid supply container 324. Fluid receiver 322 and fluid supply container 324 are substantially identical to fluid receiver 122 and fluid supply container 124 except that fluid container 324 includes cam follower 337 and communication contacts 380 in place of cam 175 and contacts 180 while fluid receiver 322 includes cam 375 and contacts 340 in place of cam follower 137 and contacts 140. Those remaining components of system 320 which correspond to components of system 120 are numbered similarly. For ease of illustration, media transport 42 and print device 44 of receiver 122 (shown in FIG. 1) are not shown in FIGS. 10-14. For ease of illustration, the lower portion of fluid receiver 322 including fluid interconnect 132 and bias 135 (shown in FIG. 4) are omitted.

Cam 375 of fluid receiver 322 comprises one or more structures configured to provide a surface that engages cam follower 337 during insertion of container 324 into cavity 128 to guide or direct insertion of container 324 into cavity 128. In the particular example illustrated, cam 375 comprises a ledge or track 400 helically extending about axis 154 and about cavity 128. Track 400 does not extend completely about container 124 and forms a passage 403.

Passage 403 is configured to permit insertion of container 324 into cavity 128 such that cam follower 337 passes through passage 403 so as to be positioned along and in contact with track 400. In one embodiment, passage 403 has a shape specifically chosen to match a particular shape of cam follower 337 so as to serve as a key way, wherein cam follower 337 serves as a key. As such, passage 403 restricts what particular containers 324 may be inserted into cavity 128. In other embodiments, container 324 may include multiple passages 403 extending through track 400 and container 324 may include multiple cam followers 337 spaced about axis 154, wherein the shape and/or location of the multiple passages form key ways and the shape or location of the multiple cam followers 337 form keys for allowing selected containers 324 to be fully inserted into cavity 128 while denying complete insertion of other containers 324. In some embodiments, the one or more cam followers 337 and the one or more tracks 400 may additionally or alternatively be color-coordinated, color keyed or color-coded to indicate which of the plurality of containers containing different fluids are to be inserted into cavity 128. For example, in one embodiment, cam follower 337 may be colored yellow, indicating that only those containers having yellow cam followers 337 are to be inserted into cavity 128.

Figure 12:
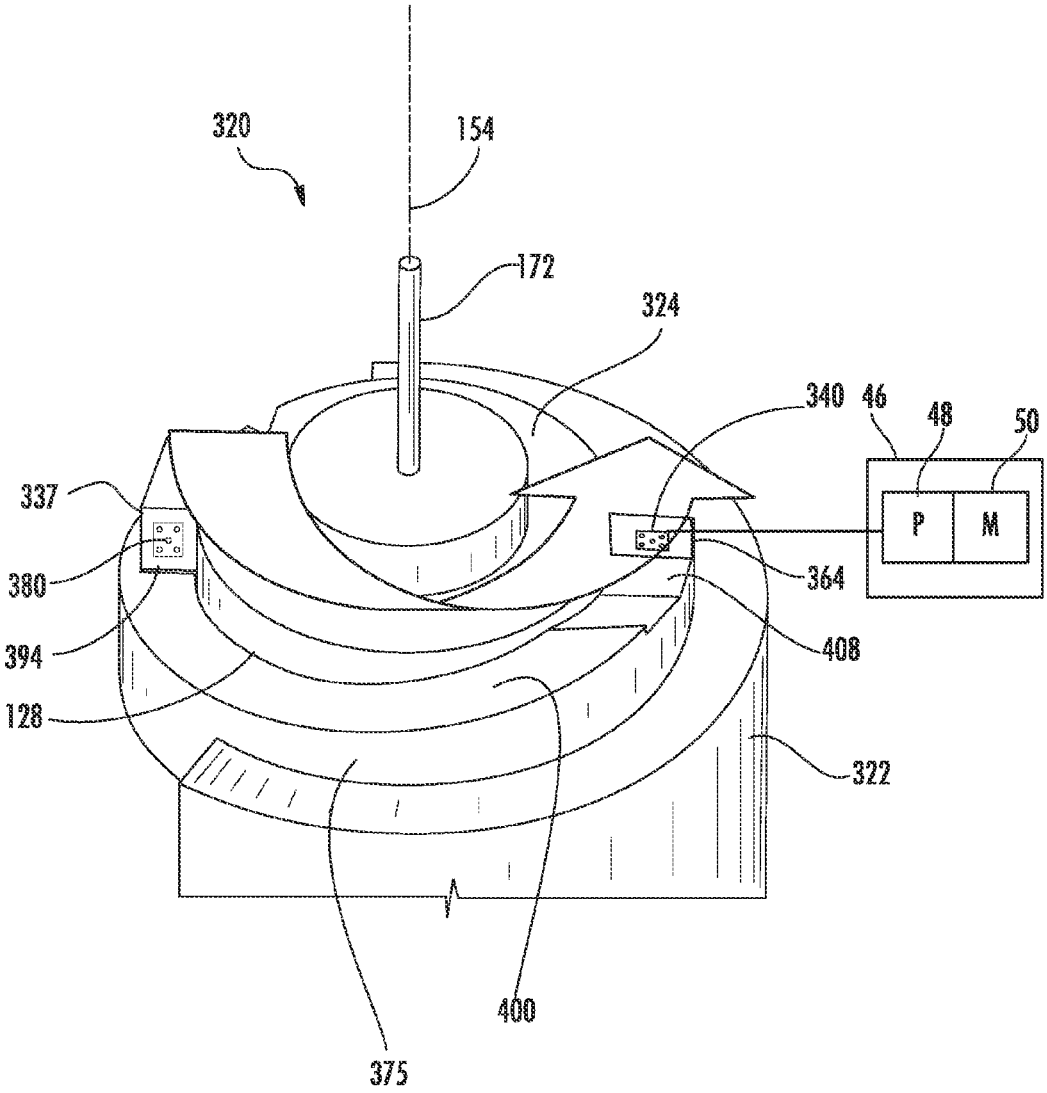

Track 400 terminates adjacent a surface 362 including communication contacts 340 (shown in FIG. 12). Communication contacts 340 comprise one or more contacts configured to transmit data, power, or control signals between controller 46 (shown to FIG. 1) of receiver 322 and an associated memory and/or processor carried by container 324. Communication contacts 340 are configured to make signal transmitting contact with one or more corresponding contacts of container 324. In one embodiment, communication contacts 340 comprise one or more electrical contact pads by which electrical signals representing data, power, or control signals may be transmitted. In another embodiment, communication contacts 340 may comprise one or more electrical pins configured to be received by one or more electrical sockets associated with container 324. In yet another embodiment, communication contacts 340 may comprise one or more electrical sockets configured to receive corresponding electrical pins associated with container 324. As shown by FIG. 12, communication contacts 340 are each connected to processor 48 of controller 46 to transmit data, power, and/or control signals to processor 48.

Surface 364 extends away from axis 154 of cavity 128. In one embodiment, surface 364 comprises a radial surface with respect to axis 154. Surface 364 is eccentric with respect to axis 154. Surface 364 is configured such that corresponding communication contacts of container 324 may be rotated into contact with contacts 340 upon rotation of container 324 about axis 154. During such rotation, communication contacts 340 are substantially opposite to and face the corresponding contacts of container 324 just prior to connection. In other words, just prior to connection of communication contacts 340 and corresponding contacts of container 324, surface 364 is substantially parallel to and faces the opposing surface along which the communication contacts of container 324 extend. As a result, transverse movement, rubbing or frictional sliding of such surfaces and the communication contacts of receiver 322 and container 324 is minimized or eliminated, reducing deformation and frictional wear to increase the reliability and robustness of system 320.

As further shown by FIG. 12, track 400 includes a detent 408 configured to at least partially receive cam follower 337 at a selected location along track 400. Detent 408 is located so as to indicate to a person inserting container 324 when container 324 has been sufficiently rotated and lowered into cavity 128 such that communication contacts 380 of container 324 are in sufficient proximity or are in contact with communication contacts 340 of receiver 122 such that communication may be achieved. In the particular example illustrated in which communication contacts 380 are provided along surface 394, detent 408 is located along track 400 in close proximity to surface 394. In other embodiments, detent 408 may be provided at other locations. In still other embodiments, track 400 may alternatively include a protuberance instead of detent 408, wherein cam follower 337 includes a corresponding detent that receives a protuberance when communication contacts 380 of container 324 are in sufficient proximity or are in contact with communication contacts 340 of receiver 322 such that communication may be achieved.

Figure 10:
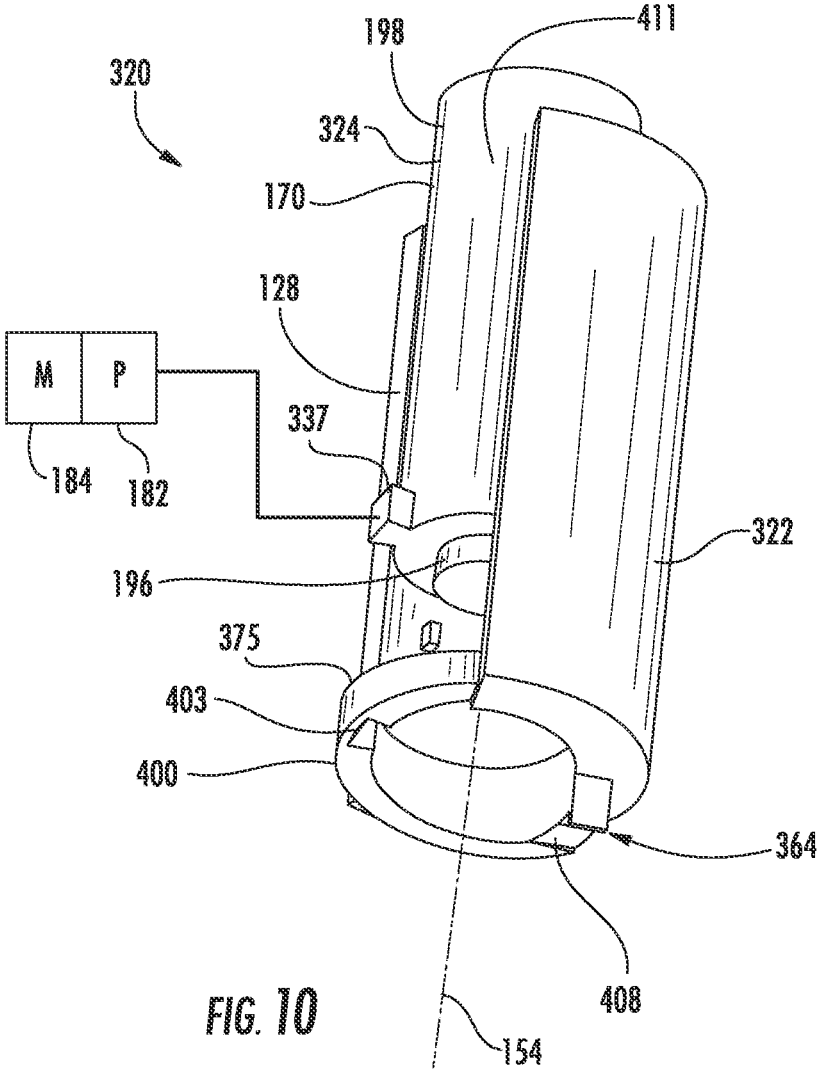
FIG. 10 is a perspective view of another embodiment of the fluid supply receiving system of FIG. 1 illustrating a fluid receiver in section according to an example embodiment.

As further shown by FIG. 12, cam follower 337 includes a surface 394 including communication contacts 380. Communication contacts 380 are configured to make signal transmitting contact with one or more corresponding contacts 340 of receiver 322. In one embodiment, communication contacts 380 serve as electrical interconnects and comprise one or more electrical contact pads by which electrical signals representing data, power, or control signals may be transmitted. In another embodiment, communication contacts 380 may comprise one or more electrical pins configured to be received by one or more electrical sockets serving as contacts 340. In yet another embodiment, communication contacts 380 may comprise one or more electrical sockets configured to receive corresponding electrical pins serving as contacts 340. As shown by FIG. 10, communication contacts 380 are each connected to processor 182 to transmit data, power, and/or control signals to processor 182. In another embodiment, in which processor 182 is omitted, contacts 380 may be directly connected to memory 184, wherein data is read from memory 184 by receiver 322.

Communication contacts 380 are located along surface 394. Surface 394 extends away from axis 154 of cavity 128. In one embodiment, surface 394 comprises a radial surface with respect to a centerline of container 324 and with respect to axis 154 when container 354 is received within cavity 128. Surface 394 is eccentric with respect to axis 154. Surface 394 is configured such that communication contacts 380 of container 324 may be rotated into contact with contacts 340 upon rotation a container 324 within cavity 128 and about axis 154. During such rotation, communication contacts 180 are substantially opposite to and face the corresponding contacts 340 just prior to connection. In other words, just prior to connection of communication contacts 380 and corresponding contacts 340, surface 394 is substantially parallel to and faces the opposing surface 364. As a result, transverse movement, rubbing or frictional sliding of such surfaces and the communication contacts 380 and 340 is minimized or eliminated, reducing deformation and frictional wear to increase the reliability and robustness of system 320.

In other embodiments, communication contacts 380 may alternatively be located along bottom 196 or along circumferential sides 198 of body 170. For example, in one embodiment, contacts 380 may be formed along a ring extending about axis 154 along bottom 196. In another embodiment, contacts 380 may be formed in a ring about axis 154 along side 198. In such embodiments with rings of one or more contacts 380, communication is facilitated without precise rotational alignment or positioning of container 324 with respect to cavity 128. In still another embodiment, contacts 380 may be provided at a discrete location (not a continuous ring) at bottom 196 or side 198, wherein contacts 380 are rotated into close proximity or contact with contacts 340 to facilitate communication between container 124 and receiver 322.

Communicating contacts 380 are connected to processor 182 and memory 184 which are schematically shown and described above with respect to system 120. As noted above, processor 182 and memory 184 are carried by container 324.

Figure 11:
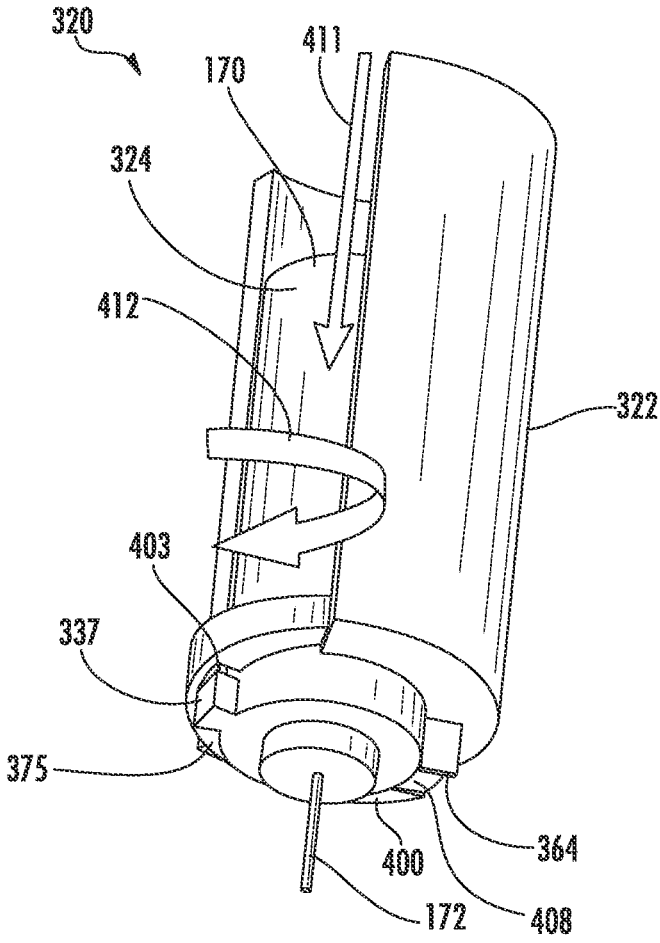
FIGS. 11-14 are fragmentary perspective views illustrating insertion of a fluid supply container of the system of FIG. 10 being inserted into the fluid receiver according to an example embodiment.

FIGS. 10-14 further illustrate insertion of container or 324 into receiver 322. As shown by FIG. 10, container 324 is initially inserted into cavity 128 by being translated in the direction indicated by arrow 411. As shown by FIG. 11, once cam follower 337 has been aligned with passage 403 and has been pushed through passage 403 against the bias provided by bias 135 (shown in FIG. 4), container 324 is rotated in the direction indicated by arrow 412. As a result, bias 135 resiliently urges cam follower 337 against track 400.

Figure 13:
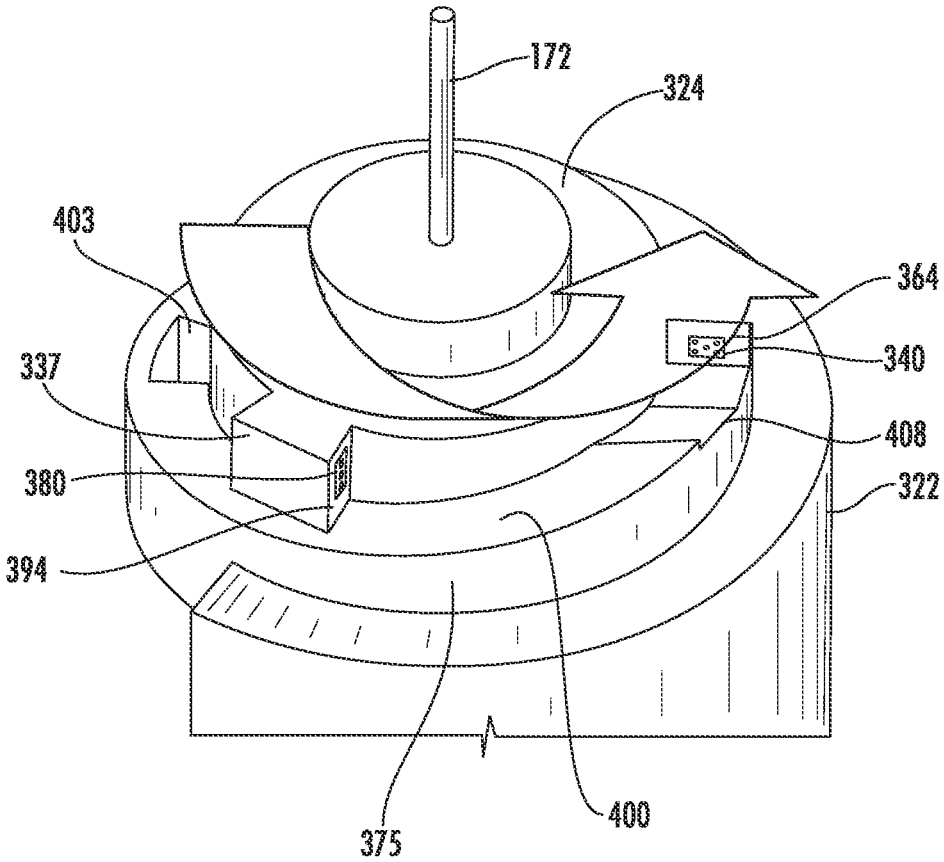
Figure 14:
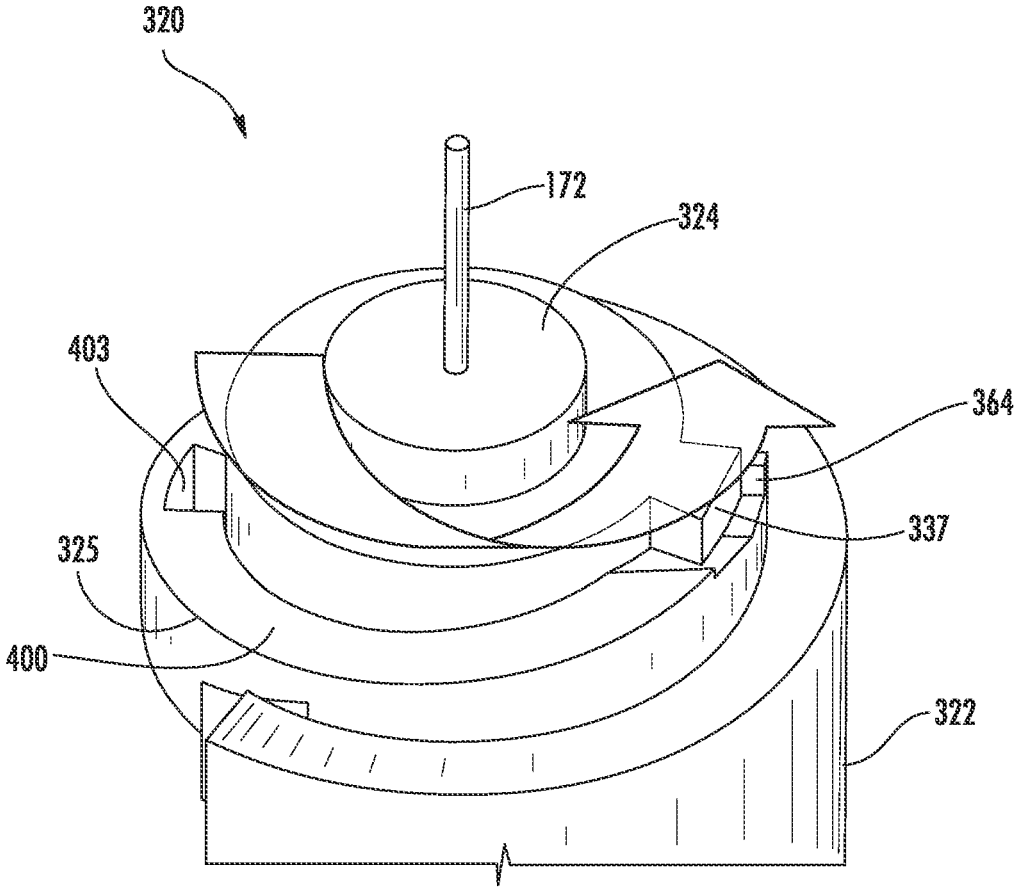

As shown by FIGS. 12 and 13, container 124 is rotated in the direction indicated by arrow 412. Because track 400 is helical, such rotation further results in container 324 being translated against bias 135 further into cavity 128. As shown by FIG. 14, container 324 continues to be rotated in the direction indicated by arrow 412 until detent 408 receives cam follower 337. When detent 408 of track 400 receives cam follower 337, communication contacts 380 along surface 394 (shown in FIG. 12) are in contact with or insufficient proximity to communication contacts 340 of receiver 322 such that data, power, or control signals may be transmitted across contacts 340 and contacts 380. Due to the reception of cam follower 337 by detent 408, the person inserting container 324 is provided with a tactile indication and an audible indication that container 324 has been sufficiently inserted and rotated. At the same time, 408 also serves as a retainer by retaining container 324 in place against bias 135 with contacts 380 in contact or in sufficient proximity to contacts 340 for communication.

Figure 15:
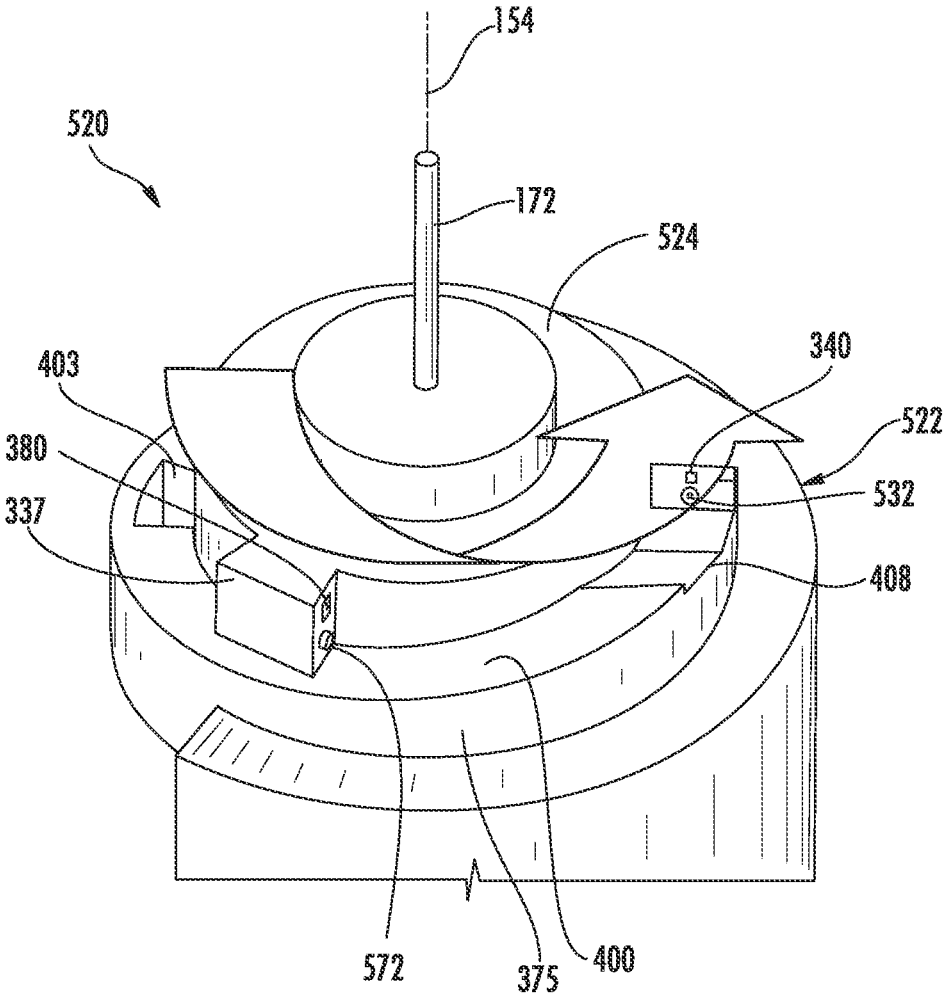
FIG. 15 is a fragmentary bottom perspective view of another embodiment of the fluid supply and receiving system of FIG. 1 according to an example embodiment.

FIG. 15 illustrates fluid supply and receiving system 520, another embodiment of fluid supply receiving system 20. System 520 is similar to system 320 except that system 520 includes fluid receiver 522 in place of receiver 322 and includes fluid supply container 524 in place of container 324. Fluid receiver 522 it itself similar to fluid receiver 322 except that fluid receiver 522 includes fluid interconnect 532 in place of fluid interconnect 132. Likewise, fluid supply container 524 is itself similar to container 324 except that container 524 includes fluid interconnect 572 in place of fluid interconnect 172. Those remaining elements of receiver 522 and container 524 as well as those remaining elements of 520 which correspond to similar components of fluid receiver 322, container 324 and system 320, respectively, are numbered similarly. As shown by FIG. 15, fluid interconnect 532 is formed upon surface 364 of receiver 522 while fluid interconnect 572 projects from surface 394 of container 522.

Figure 16:
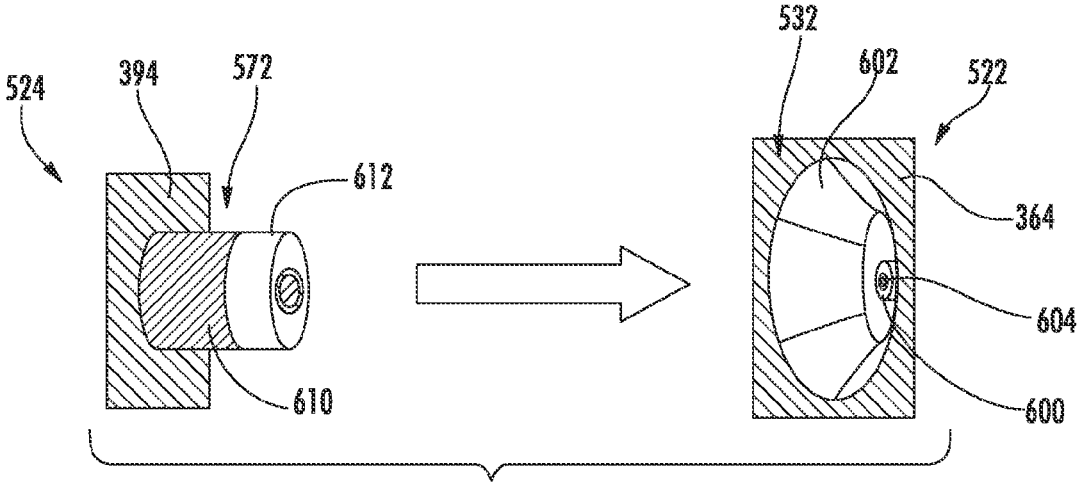
FIG. 16 is a perspective view illustrating fluid interconnects of the system of FIG. 15 prior to fluid connection according to an example embodiment.
Figure 17:
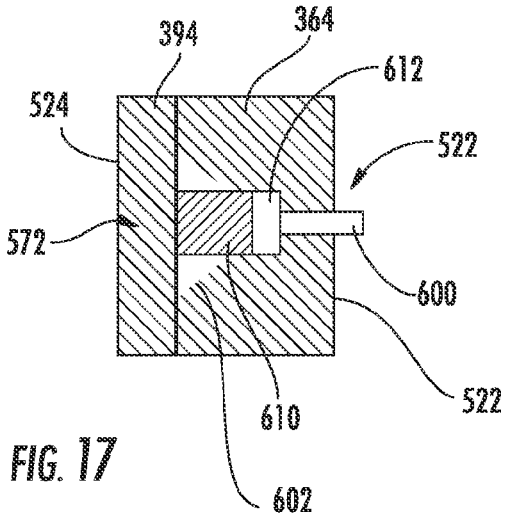
FIG. 17 is a sectional view illustrating the fluid interconnects of FIG. 16 after fluid connection according to an example embodiment.

FIGS. 16 and 17 illustrate fluid interconnect 532 and 572 in more detail. As shown by FIGS. 16 and 17, fluid interconnect 532 comprises a needle 600 and a funnel 602. Needle 600 is configured to penetrate a septum of fluid interconnect 572. Needle 600 includes an internal passage in communication with either an axial opening or side opening 604 through which fluid flows through needle 600 to fluid consuming components of fluid receiver 522, such as print device 44 (shown in FIG. 1).

Funnel 602 comprises a frusto-conical surface extending about needle 600. Another embodiment, funnel 602 may include three or more angled planar sides which taper to serve as a funnel. Funnel 600 guides, direct or funnels fluid interconnect 572 of container 524 into alignment and connection with needle 600. In other embodiments, a funnel 602 may be omitted.

Fluid interconnect 572 transfers of fluid from container role 524 to receiver 522 upon connection of interconnect 572 to interconnect 532. Fluid interconnect 572 includes stem 610 and septum 612. Stem 610 comprises a resiliently flexible post or column extending from surface 394. Stem 610 supports septum 612. Stem 610 is resiliently flexible so as to resiliently to form or bend when brought into contact with funnel 602 such that septum 612 may be brought into contact with needle 600. Stem 610 includes an internal passage in fluid communication or fluidly connected to internal fluid chamber of container 524. Because stem 610 is resiliently flexible, and because fluid interconnect 532 includes funnel 602, septum 612 and needle 680 may be brought into connection with one another even in the presence of slight misalignments resulting from the rotation of container 524. As shown by FIG. 17, when container 524 is rotated about axis 154 to rotate or bring communication contacts 340 and 380 into communicating contact with one another, septum 612 of fluid interconnect 572 is also rotated into fluid transmitting connection with needle 600 of fluid interconnect 532. Needle 600 penetrates septum 612 to complete the fluid connection.

In other embodiments, stem 610 may not be resiliently flexible. In other embodiments, funnel 602 may be omitted. In other embodiments, fluid interconnect 532 may alternatively include stem 610 and septum 612 while fluid interconnect 572 includes needle 600 and funnel 602. In other embodiments, fluid interconnect supply 32 in 572 may have other configurations.

Figure 18:
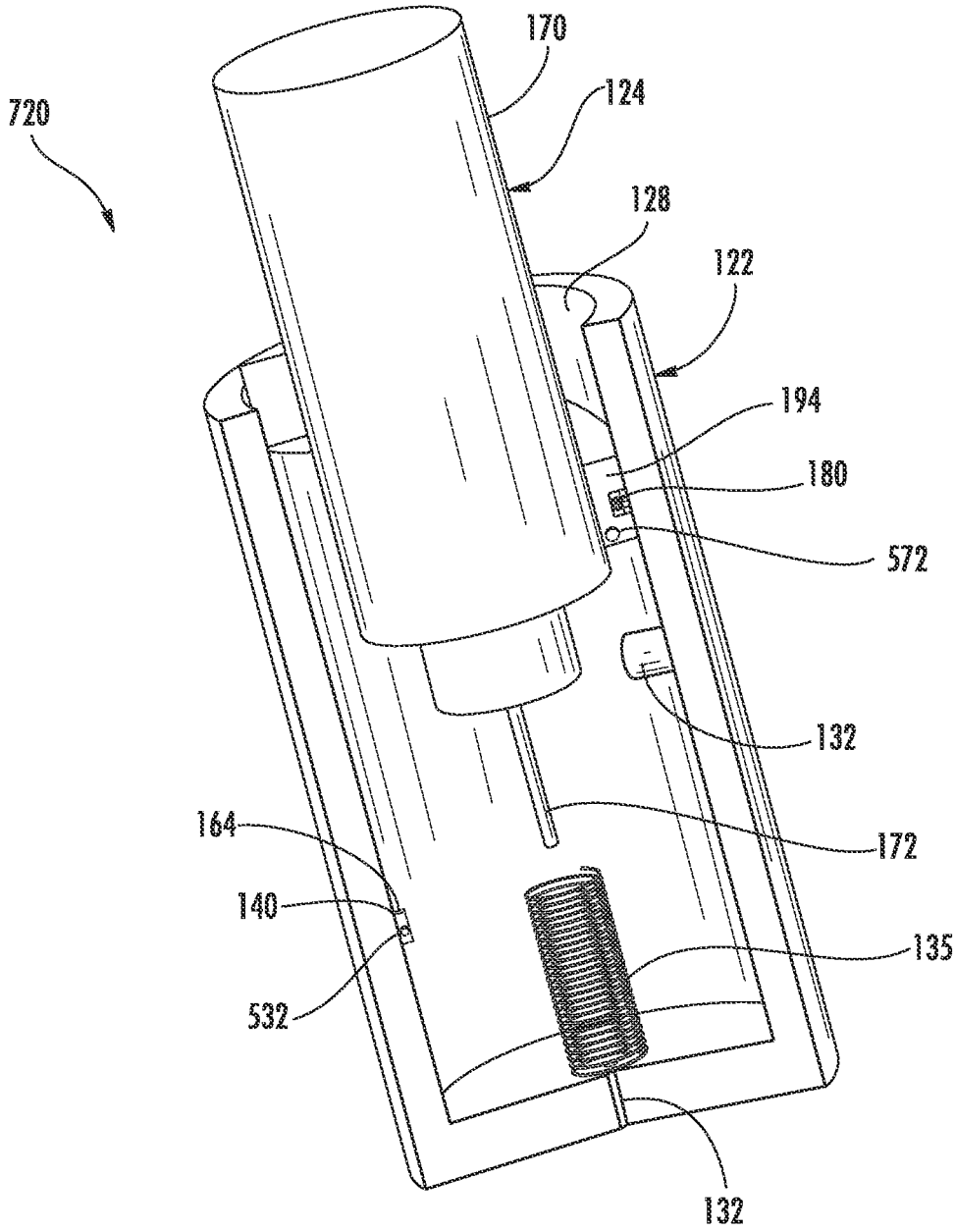
FIG. 18 is a perspective view of another embodiment of the fluid supply receiving system of FIG. 1 illustrating a fluid receiver in section according to an example embodiment.

FIG. 18 illustrates fluid supply and receiving system 720, another embodiment of system 20. System 720 is similar to 120 except that system 720 includes fluid interconnects 532 and 572 (described above) in place of fluid interconnects 132 and 172. Elements of system 720 which correspond to elements of system 120 are numbered similarly. For ease of illustration, media transport 42, print device 44, controller 46 of receiver 122 (shown in FIG. 1) and processor 182 and memory 184 of container 124 (shown in FIG. 6) are not shown in FIG. 18. Fluid interconnects 532 and 572 are located along surfaces 164 and 194, respectively. As a result, fluid interconnects 513 and 572 are rotated into fluid connection with one another during rotation of container 124. As in system and role 520, interconnects 532 and 572 in system 720 provide for reliable fluid interconnection despite manufacturing misalignments or misalignments occurring during the rotation of container 124.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An ink supply for a printer, comprising:

a first ink supply container comprising:

a body configured to contain ink;

a first contact carried by the body and configured to facilitate data, power, or control signal transmission from the first contact to a second contact associated with the printer, wherein the first contact is configured to be rotated about an axis into contact with the second contact; and a needle configured to be inserted through a septum associated with the printer.

2. The ink supply of claim 1, wherein the first contact is along a surface extending away from the axis.

3. The ink supply of claim 1, wherein the first ink supply container further comprises one of a first cam follower and a first cam on an exterior of the body configured to engage the other of the first cam follower and the first cam of the printer, wherein the first cam follower and the first cam cooperate to translate the first ink supply container along the axis as the first ink supply container is rotated about the axis.

4. The ink supply of claim 3, wherein the first ink supply container includes the first cam and wherein the first cam has an axially facing surface helically extending about the axis.

5. The ink supply of claim 3, wherein the first ink supply container includes the first cam and wherein the first cam includes a passage configured to permit the first cam follower to be passed through the first cam.

6. The ink supply of claim 3, wherein the first ink supply container includes the first cam and wherein the first cam includes a detent configured to receive the first cam follower only when the first contact is positioned against the second contact.

7. The ink supply of claim 3, wherein the first ink supply container includes the first cam, the ink supply further comprising a second ink supply container substantially identical to the first ink supply container except that the second ink supply container includes a second cam different than the first cam.

8. The ink supply of claim 3, wherein the first ink supply container includes the first cam follower, the ink supply further comprising a second ink supply container substantially identical to the first ink supply container except that the second ink supply container includes a second cam follower different than the first cam follower.

9. The ink supply of claim 1, wherein the first ink supply container has an axial face (96, 196) including a first ink interconnect.

10. The ink supply of claim 1, wherein the ink supply includes an ink interconnect extending along a surface extending away from the axis and is configured to be rotated about the axis into interconnection with a second ink interconnect of the printer.

11. The ink supply of claim 10 further comprising a resiliently flexible post supporting the first ink interconnect.

12. An ink supply for a printing device comprising:

a body configured to contain ink;

a first contact carried by the body and configured to facilitate data, power, or control signal transmission from the first contact to a second contact associated with the printing device, wherein the first contact is along a surface extending away from the axis and wherein the first contact is configured to be rotated about an axis into contact with the second contact;

one of a first cam follower and a first cam on an exterior of the body configured to engage the other of the first cam follower and the first cam of the printer, wherein the first cam follower and the first cam cooperate to translate the contact along the axis as the contact is rotated about the axis; and a needle configured to be inserted through a septum associated with the printing device.

13. The ink supply of claim 12, wherein the body has an axial face including an ink interconnect.

14. An ink supply for a printing device comprising:

a body configured to contain ink, wherein the body has an axial face including an ink interconnect;

a first contact carried by the body and configured to facilitate data, power, or control signal transmission from the first contact to a second contact associated with the printing device, wherein the first contact is along a surface extending away from the axis wherein the first contact is configured to be rotated about an axis into contact with the second contact; and a needle configured to be inserted through a septum associated with the printing device.

15. The ink supply of claim 14, wherein the body further comprises one of a first cam follower and a first cam on an exterior of the body configured to engage the other of the first cam follower and the first cam of the printing device, wherein the first cam follower and the first cam cooperate to translate the first contact along the axis as the first contact is rotated about the axis.

* * * * *